US010188168B2

(12) United States Patent
Tubbs

(10) Patent No.: US 10,188,168 B2
(45) Date of Patent: Jan. 29, 2019

(54) SHOCK-ABSORBENT JUNCTION APPARATUS AND FACEMASK SYSTEM

(71) Applicant: NXL Technologies, Inc., Miami, FL (US)

(72) Inventor: Clifford L. Tubbs, Miami, FL (US)

( * ) Notice: Subject to any disclaimer, the term of this patent is extended or adjusted under 35 U.S.C. 154(b) by 170 days.

(21) Appl. No.: 15/249,735

(22) Filed: Aug. 29, 2016

(65) Prior Publication Data

US 2017/0056752 A1 Mar. 2, 2017

Related U.S. Application Data

(60) Provisional application No. 62/211,365, filed on Aug. 28, 2015.

(51) Int. Cl.
*A42B 3/20* (2006.01)

(52) U.S. Cl.
CPC ..... *A42B 3/20* (2013.01)

(58) Field of Classification Search
CPC ..... A42B 3/20; A42B 3/00; A42B 3/04
See application file for complete search history.

(56) References Cited

U.S. PATENT DOCUMENTS 4,870,353 A * 9/1989 Cook ..... F16F 1/08 324/754.14
2008/0163410 A1* 7/2008 Udelhofen ..... A42B 3/20 2/413

* cited by examiner

*Primary Examiner* — Kristen Matter
(74) *Attorney, Agent, or Firm* — Eugenio J. Torres-Oyola; Victor M. Rodriguez-Reyes; Rafael Rodriguez-Muriel

(57) ABSTRACT

The present disclosure is directed to a shock-absorbent junction between the facemask and the helmet of a user, thus minimizing the likelihood of neck and cranial injury by maximizing impact energy absorption. The shock-absorbent junction including a first plate, a resilient material, and a second plate. Due to the possible geometrical symmetry of this embodiment, it is possible that the facemask be adapted in order to be attached to the first plate while the helmet would be adapted to the second plate.

14 Claims, 12 Drawing Sheets

SHOCK-ABSORBENT JUNCTION APPARATUS AND FACEMASK SYSTEM

STATEMENT REGARDING FEDERALLY SPONSORED RESEARCH AND DEVELOPMENT

N/A

RELATED APPLICATIONS

This application is related to U.S. provisional patent application Ser. No. 62/078,814 filed on Aug. 28, 2015.

BACKGROUND OF THE DISCLOSURE

Field of the Invention

The invention relates generally to the field of injury preventive gear, and more particularly, to athletic helmet-facemasks.

Background

In contact sports such as American football, injury is relatively common due to the collisions and force of impact between players. Over 4 million concussion and sports-related brain injuries occur each year with nearly 48,000 reported cases occurring in youth football leagues and 250,000 in high school football programs. It is also estimated that more than 35,000 injuries go undiagnosed annually.

Concussions, in particular, happen to be one of the most severe hazards for football players. Concussions occur from physical trauma to the cranial region and can result in serious life-long disabilities. Due to this danger, football helmets play a crucial role in player safety and concussion prevention.

Football helmets and the facemasks attached thereto are designed to absorb the impact energy generated from the collision with other players through material elastic deformation. Such a design is simple, but does not effectively absorb the impact forces that are commonly experienced by football helmets. Current facemasks do not transfer impact forces experienced by a player in an effective manner so as to maximize energy absorption and minimize inertial forces because of the manner they are attached to the football helmet.

It would therefore be desirable to have a facemask junction with improved energy-transfer features from existing facemask junction designs in order to decrease the likelihood of user-sustained concussions.

It would also be desirable to have a facemask system with improved energy-transfer features from existing facemask configurations in order to decrease the likelihood of user sustained concussions.

While certain aspects of conventional technologies have been discussed to facilitate disclosure of the invention, Applicant in no way disclaims these technical aspects, and it is contemplated that the claimed invention may encompass one or more of the conventional technical aspects discussed herein.

In this specification where a document, act, or item of knowledge is referred to or discussed, this reference or discussion is not an admission that the document, act, or item of knowledge or any combination thereof was at the priority date, publicly available, known to the public, part of common general knowledge, or otherwise constitutes prior art under the applicable statutory provision; or is known to be relevant to an attempt to solve any problem with which this specification is concerned.

SUMMARY

An embodiment of this invention is directed to an apparatus that satisfies the need for a shock-absorbent junction between the facemask and the helmet of a user, thus minimizing the likelihood of neck and cranial injury by maximizing impact energy absorption. The embodiment comprises: a first plate, a set of at least three springs, and a second plate. The first plate has a first top face and a first bottom face. A set of at least three springs, is included wherein each spring has a first end and a second end, and the first ends of the springs are fixed onto the first bottom face of the first plate. The second plate has a second top face and second bottom face with the second top face being fixed to the second ends of the springs.

This embodiment of the invention is to be used as a flexible junction between a facemask and a helmet. The facemask would. necessarily be adapted in order to be attached to the first top face and the helmet would necessarily be adapted in order to be attached to the second bottom face. Due to the possible geometrical symmetry of this embodiment, it is possible that the facemask be adapted in order to be attached to the second bottom face as well, in this configuration, the helmet would be adapted in order to be attached to the first top face.

Another embodiment of this invention is directed to a facemask system that satisfies the need for an improved shock absorber between the face of a user and the impacting object so as to minimize the likelihood of neck and cranial injury. The embodiment comprises a: facemask, first plate, a set of at least three springs, and a second plate. The first plate has a first top face and a first bottom face. The facemask is attached to the first top face. A set of at least three springs, is included wherein each spring has a first end and a second end, and the first ends of the springs are fixed onto the first bottom face of the first plate. The second plate has a second top face and second bottom face with the second top face being fixed to the second ends of the springs. The system may be adapted to any helmet or a helmet may be included with the system. If a helmet is included in the system, it would be attached to the second bottom face of the second plate. Like in the previous embodiment, the orientation of the helmet and the facemask are reversible with respect to the other components of the system. In such a configuration, the helmet would be attached to the first top face of the first plate and the facemask would be attached to the second bottom face of the second plate.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

BRIEF DESCRIPTION OF THE DRAWINGS

These and other features, aspects, and advantages of the present invention will become better understood with regard to the following description, appended claims and accompanying drawings where:

DETAILED DESCRIPTION

Figure 1:
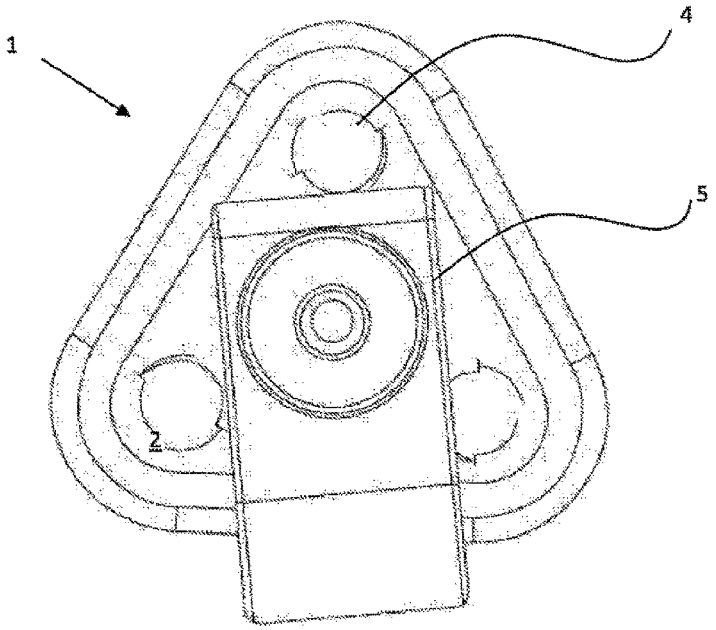
FIG. 1 is a front view in accordance with an embodiment of the present invention showing a shock-absorbent junction apparatus.

In the Summary above, in the Description and appended Claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally. The term 'comprises' and grammatical equivalents thereof are used herein to mean that other components, structures, steps, etc. are optionally present. For example, an article "comprising" (or "which comprises") components A, B, and C can consist of (i.e., contain only) components A, B, and C, or van contain not only components A, B, and C, but also one or more other components or structures.

The term "at least" followed by a number is used herein to denote the start of a range beginning with that number (which may be a range having an upper limit or no upper limit, depending on the variable being defined). For example, "at least 1" means 1 more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose lower limit is the first number and whose upper limit is the second number. For example, 25 to 100 mm means a range whose lower limit is 25 mm, and whose upper limit is 100 mm.

The term "mechanical features" is used herein to mean features of a component, mechanical or geometric, which have a functional purpose of attaching or linking that component to one or more other components with compatible or corresponding mechanical features. An example of a mechanical feature is a slot in a component, where said slot is designed to accept a tab from another component and the union of the slot and tab from the two components effectively links, attaches, fixes, and/or locks the components together. The term "mechanical features" refers to, but is not limited to: clips, hooks, hook and loop fasteners, slot and tabs, all male and female fasteners, screws, bolts, nuts, holes that have been tapped, latches, pins, etc.

While the specification will conclude with claims defining the features of embodiments of the invention that are regarded as novel, it is believed that the invention will be better understood from a consideration of the following description in conjunction with the figures, in which like reference numerals are carried forward.

Figure 7:
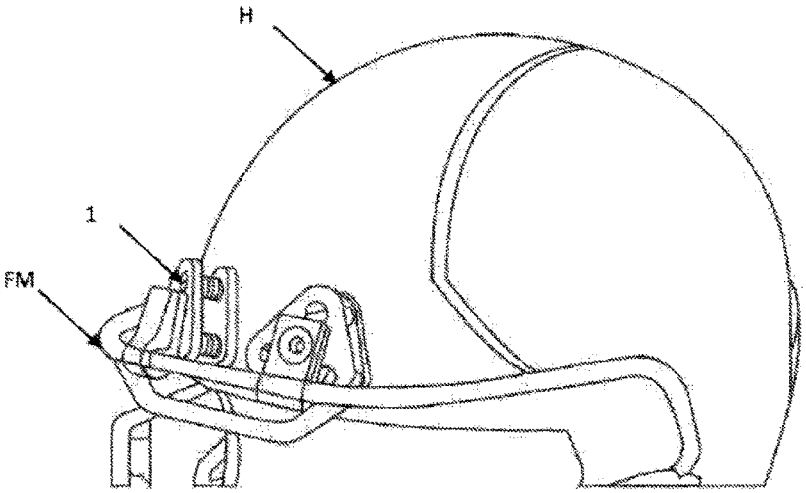
FIG. 7 is a diametric view in accordance with an embodiment of the present invention showing a facemask system as installed on a helmet.
Figure 8:
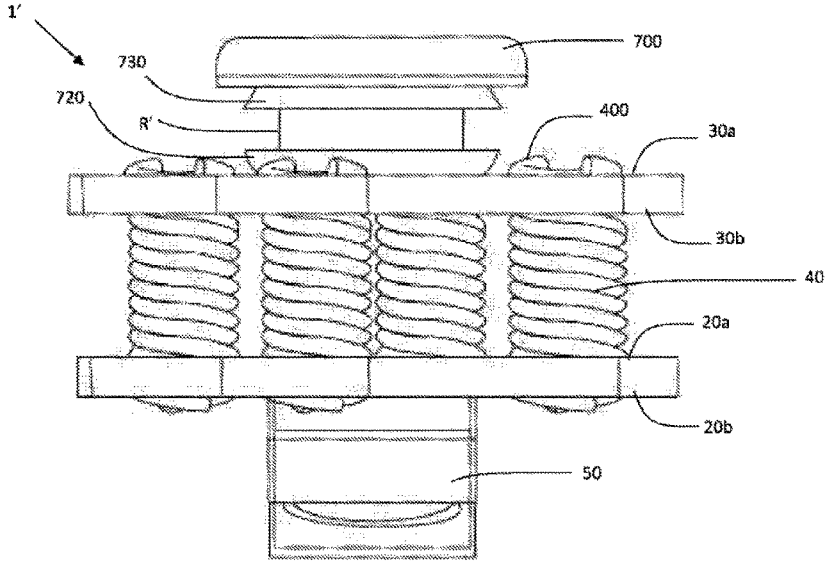
FIG. 8 is a side view in accordance with another embodiment of the present invention showing a shock-absorbent junction apparatus.

Referring to FIGS. 1, through 7, a first preferred embodiment of the present invention is in the form of a shock-absorbent junction apparatus 1 is disclosed. The shock-absorbent junction apparatus includes a first plate 2 with a first top face 2 *a* and a first bottom face 2 *b*; a means for attaching 5 said first top face to a facemask FM attached to said first top face 2 *a*; a resilient material 41, wherein said resilient material comprises a first set of at least three springs, wherein each spring has a first end and a second end, said first ends of said springs are fixed onto said first bottom face of said first plate 2 *b*; a second plate 3 with a second top face 3 *a* and second bottom face 3 *b*, wherein said second top face 3 *a* is fixed to said second ends of said resilient material 41; and a means for attaching 7 said second bottom face 3 *b* to a helmet H attached to said second bottom face 3 *b*.

Figure 2:
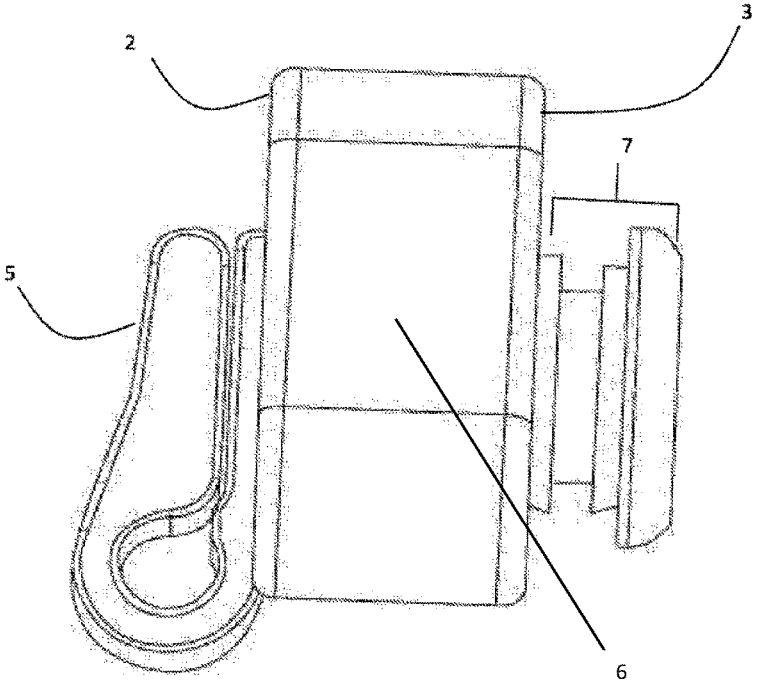
FIG. 2 is a side view in accordance with an embodiment of the present invention showing a shock-absorbent junction apparatus.
Figure 5:
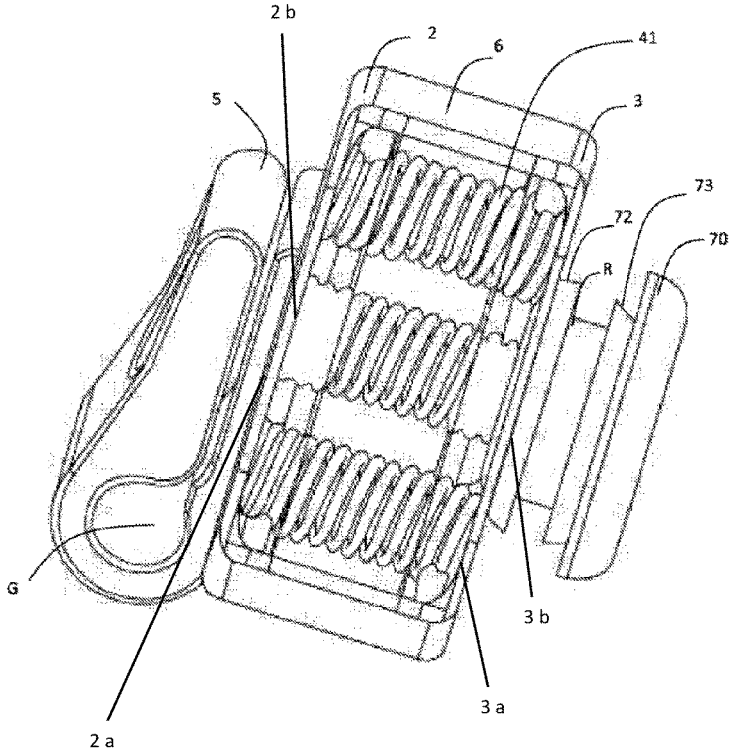
FIG. 5 is an oblique cross-sectional view in accordance with an embodiment of the present invention showing a shock-absorbent junction apparatus.

As shown in FIG. 5, the shock-absorbent junction apparatus 1 comprises features to mechanically couple said resilient material 41 to said first plate 2 and second plate 3. Each plate comprises receiving surfaces 4. The first plate 2 and second plate 3 may be just spaced apart or separated by a surface intended to cover said resilient material 41, as shown in FIG. 2. The cover 6 comprises a shroud made of a flexible material such as rubber or a soft plastic. This shroud would cover the space between the first plate 2 and second plate 3 so as to prevent foreign objects from entering the space and inhibiting the functioning of the resilient material 41.

Figure 3:
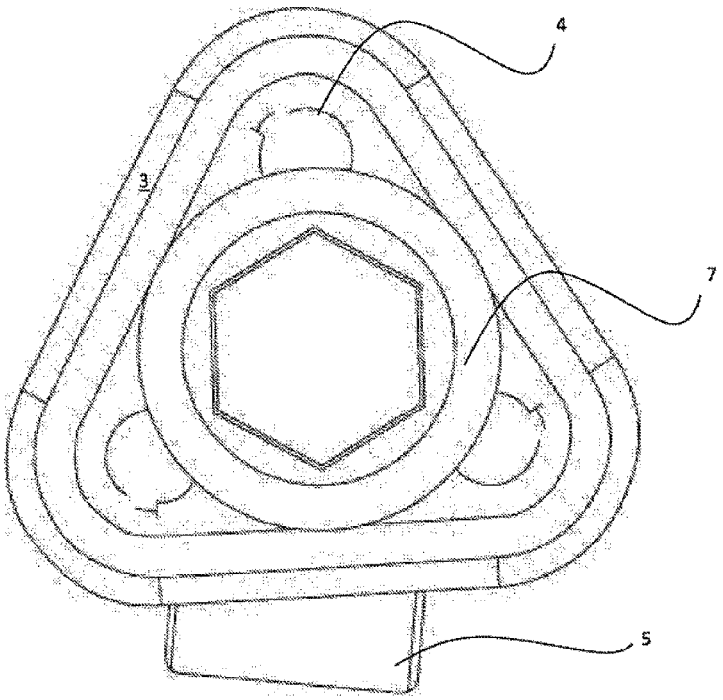
FIG. 3 is a rear view in accordance with an embodiment of the present invention showing a shock-absorbent junction apparatus.

The first plate 2 is mechanically coupled to said facemask FM by a first attaching element 5. The attaching element or the means for attaching 5 the first top face to a facemask can be in a variety of forms or by using a variety of mechanical features. Ideally, the means for attaching the first top face 2 *a* to a facemask FM should take the form of a mechanical junction that is simple to install while strong enough to withstand impact forces that it is expected to undergo during use. In FIGS. 1 through 3, an embodiment of the present invention uses a clip that is bolted. to the first top face 2 *a* of the apparatus. This clip features a geometric design that is capable of receiving a portion of the facemask FM to be used and affixing it to the shock-absorbent junction apparatus 1. The manner by which the clip achieves this task can be seen in FIG. 7.

Figure 4:
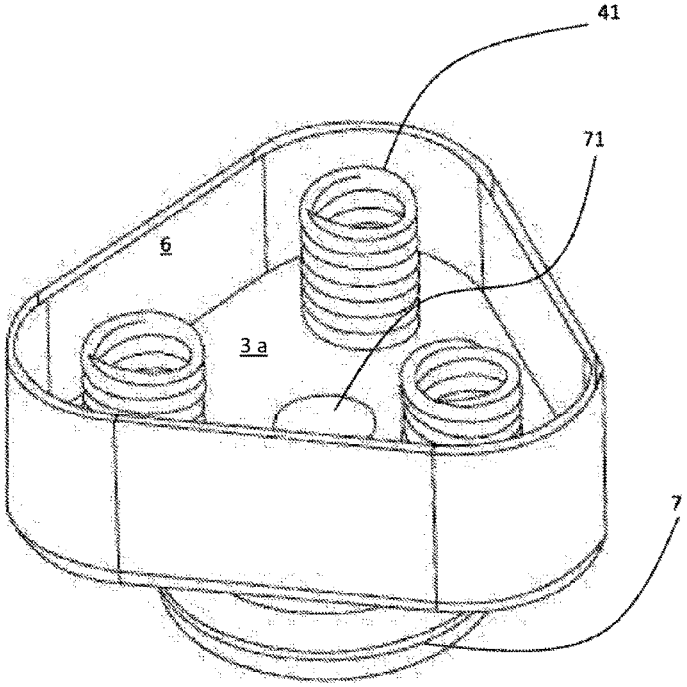
FIG. 4 is a trimetric cross-sectional view in accordance with an embodiment of the present invention showing a shock-absorbent junction apparatus with first plate removed.

The second plate 3, as shown in FIG. 3, is mechanically coupled to said helmet H by a second attaching element 7. The second attaching elements or means for attaching 7 said second bottom face 3 *b* to a helmet H can be in a variety of forms or by using a variety of mechanical features. Ideally, the means for attaching the second bottom face 3 *b* to said helmet should take the form of a mechanical junction that is simple to install while strong enough to withstand impact forces that it is expected to undergo during use. In FIGS. 4 and 5 an embodiment of the present invention uses a button 700 that is bolted to the second bottom face 3 *b* of the apparatus 1. This button is geometrically capable of being mated by means of a recess R with a slot, gap, or hole featured on the helmet H. By mating the button with the slot, gap, or hole of the helmet H, the shock-absorbent junction apparatus is fixed firmly to the helmet H. In the instant case the button comprises at least two flanges 72, 73 assisting for a more firmed support of said second plate 3 to said helmet H.

FIG. 4 also discloses a preferred embodiment for the resilient material or element 41. The resilient material 41 comprises a first set of at least three springs arranged at the plate surfaces and extended vertically between said plates, as shown in FIG. 5. The first set of springs is contemplated to require a minimum of three springs for stability. With a minimum of three springs, the shock-absorbent junction apparatus is capable of absorbing impact forces that are both direct and torsional on all three axes. Although it is anticipated that a single spring or a set of two springs may also be able to absorb such forces, a triangular configuration of a minimum of three springs provides the stable shock-absorbing properties that are desired. Other embodiments of the invention may also include a set of four springs, as explained below and shown in FIG. 2, in a square configuration or a set of more than four springs in a circular or spiral configuration. The coupling or assembly of the present disclosure is presented in FIG. 7. The second plate is attached to the helmet by the button 7 and the facemask FM is attached to the first plate 2 by the attaching element 5.

Figure 6:
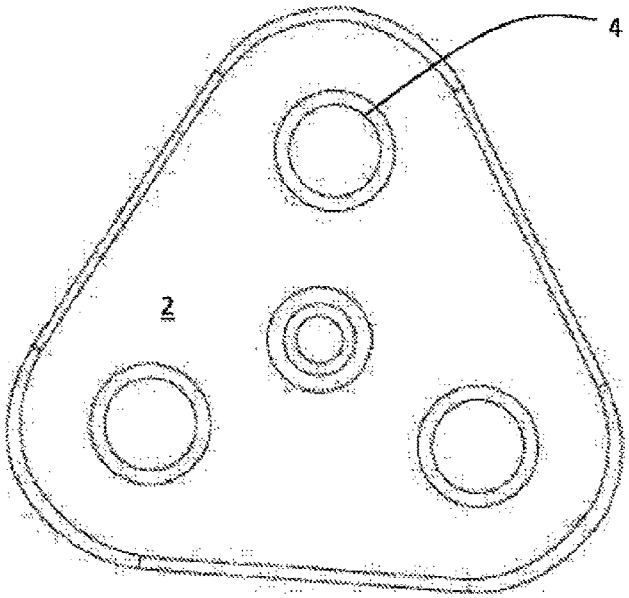
FIG. 6 is a rear cross-sectional view in accordance with an embodiment of the present invention showing a shock-absorbent junction apparatus with second plate removed.

The springs may be fixed to the first plate and second plate faces in a variety of ways. In addition to the use of mechanical features for holding the springs in place, it is contemplated that the springs may be fixed via chemical adhesives such as glue, epoxy or acrylic adhesive. A preferred embodiment of the present invention fixes the springs to the first and second plate faces by fusing the ends of the springs to the plates. FIG. 6 shows the receiving surface of the first plate for receiving the resilient element 41. If the plates 2,3 are composed of a metal, the spring's may be fused by soldering or melting among other means. If the plates 2,3 are made of plastic, the springs may be fused by impregnating the springs into the plastic plates during fabrication.

FIG. 8 through 12 are directed to the second embodiment of the present. disclosure. Similar to the first preferred embodiment the shock-absorbent junction apparatus 1' includes a first. plate 20 with a first top face 20 *a* and a first bottom face 20 *b*; a means for attaching 50 said first top face to a facemask FM' attached to said first top face 20 *a*; a resilient material 400, wherein said resilient material comprises a first set of at least four springs, wherein each spring has a first end and a second end, said first ends of said springs are fixed onto said first bottom face 20 *a* of said first plate 20; a second plate 30 with a second top face 30 *a* and second bottom face 30 *b*, said second top face 30 *a* is fixed to said second ends of said resilient material 40; and a means for attaching 700 said second bottom face 30 *b* to a helmet H' attached to said second bottom face 30 *b*.

The first plate 20 is mechanically coupled to said facemask FM' by a first attaching element 50. The attaching element or the means for attaching 50 the first top face to a facemask FM' can be in a variety of forms or by using a variety of mechanical features. Ideally, the means for attaching the first top face 20 *a* to a facemask FM should take the form of a mechanical junction that is simple to install while strong enough to withstand impact forces that it is expected to undergo during use. In FIGS. 9 through 12, an embodiment of the present invention uses a clip that is bolted to the first top face 20 *a* of the apparatus. This clip features a geometric design G' that is capable of receiving a portion of the facemask FM to be used and affixing it to the shock-absorbent junction apparatus 1'.

Figure 9:
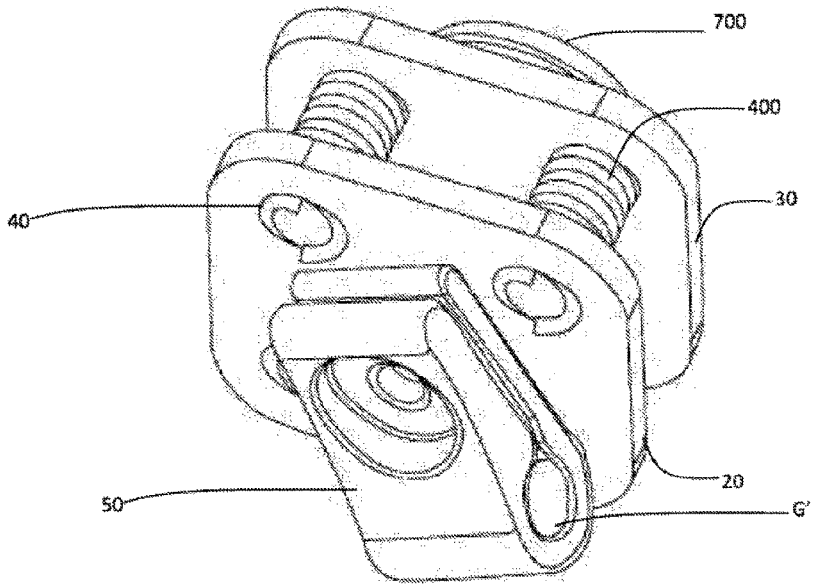
FIG. 9 is a trimetric view in accordance with another embodiment of the present invention showing a shock-absorbent junction apparatus.
Figure 10:
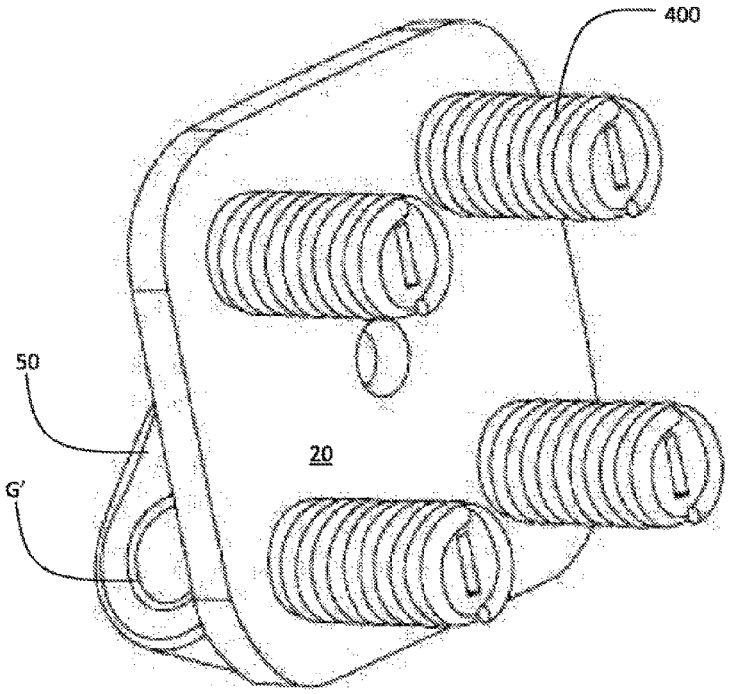
FIG. 10 is a trimetric view in accordance with an embodiment of the present invention showing a shock-absorbent junction apparatus without the second plate attached.

The resilient material 400 comprises a first set of at least four springs arranged at the plate surfaces and extended vertically between said plates, as shown in FIGS. 9 and 10. The used of four springs provides a shock-absorbent junction apparatus 1' capable of absorbing impact forces that are both direct and torsional on all three axes. A square configuration for the plates is provided for stability.

Figure 11:
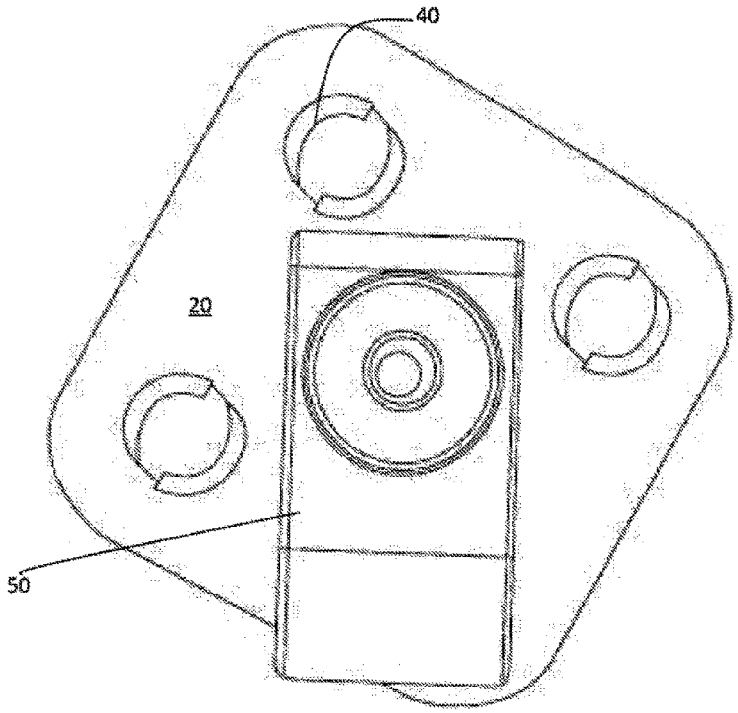
FIG. 11 is a front view in accordance with another embodiment of the present invention showing a shock-absorbent junction apparatus.

The springs may be fixed to the first plate and second plate faces in a variety of ways. Similar to the first embodiment 1, in addition to the use of mechanical features for holding the springs in place, it is contemplated that the springs may be fixed via chemical adhesives such as glue, epoxy or acrylic adhesive. A preferred embodiment of the present invention fixes the springs to the first and second plate faces by fusing the ends of the springs to the plates 20,30. FIG. 11 shows the receiving surface 40 of the first plate 20 for receiving the resilient element 41. If the plates 20,30 are composed of a metal, the springs may be fused by soldering or melting among other means. If the plates 2,3 are made of plastic, the springs may be fused by impregnating the springs into the plastic plates during fabrication.

Figure 12:
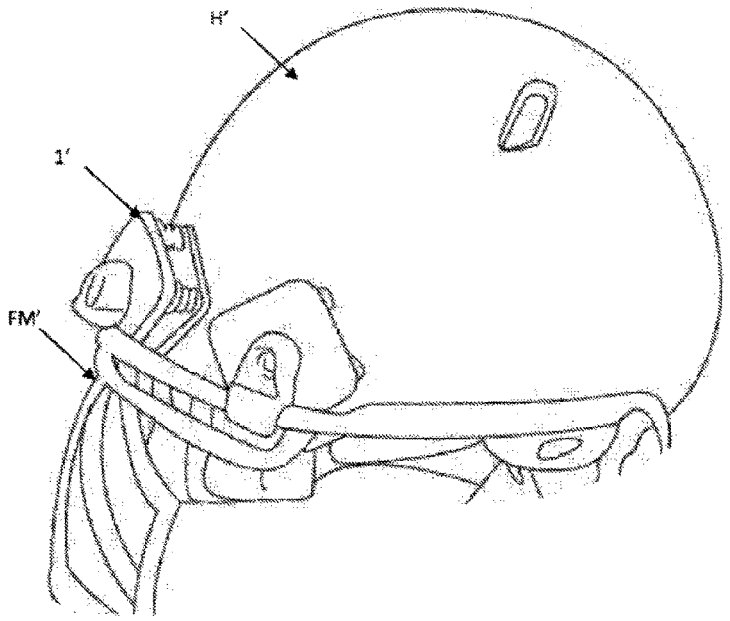
FIG. 12 is a trimetric view in accordance with an embodiment of the present invention showing a helmet with a facemask system as installed.

The coupling or assembly of the present disclosure is presented in FIG. 12, The second plate 30 is attached to the helmet H by the button 700 and the facemask FM' is attached to the first plate 20 by the attaching element 50.

An embodiment of the invention further comprises a second set of secondary springs, which may be included in the apparatus in such an arrangement that the secondary springs are concentrically aligned to the first set of springs. The second set of secondary springs can be a number of secondary springs less than or equal to the quantity of springs in the first set of springs. Each secondary spring has a first end and a second end, the first ends of the secondary springs are fixed onto the first bottom face 2 *b* of the first plate 2, and the second ends of said secondary springs are fixed to the second top face 3 *a*. The ends of the secondary springs may be fixed to the plates by the same means used to fix the ends of the springs belonging to the first set of springs. In order for the secondary springs to be concentrically aligned to the first set of springs, it is necessary that the pitch of the secondary springs substantially equal the pitch of the springs in the first set of springs. However, it is also contemplated that the secondary springs have a smaller diameter than the springs in the first set of springs. Have a configuration wherein the secondary springs have a smaller diameter than the springs in the first set of springs allows the secondary springs to have a different pitch without colliding.

As mentioned above, the present disclosure is intended to provide a shock absorbing mechanism for a helmet in the form of a facemask system comprising: a facemask FM; a first plate 2, 20 with a first top face and a first bottom face; a resilient, element 41 comprising a set of at least three springs, wherein each spring has a first end and a second end; a second plate with a second top face and second bottom face; and an attachment point that is compatible with a corresponding attachment point on a helmet H. The facemask FM is fixedly attached to the first top face of the first plate. The first ends of the springs within the set of springs are attached to the first bottom face of the first plate. The opposite ends of the springs, or the second, ends, are attached to the second top face of the second plate. This system setup results in a facemask system that is ready to be attached to any helmet that has a compatible junction point with the attachment point featured on the second bottom face of the second plate.

An alternative embodiment of the facemask system further comprises a helmet which is fixedly attached to the attachment point featured on the second bottom face of the second plate.

In light, of the foregoing description, it should be recognized that embodiments in accordance with the present invention can be realized in numerous configurations contemplated to be within the scope and spirit of the claims. Additionally, the description above is intended by way of example only and is not intended to limit the present invention in any way, except as set forth in the claims.

I claim:

1. A shock absorbing junction comprising:

a first plate;

a second plate;

a resilient material comprising at least three springs having a triangular configuration;

a clip comprising an opening for receiving a portion of a facemask;

a button shaped to mate with a slot in a helmet;

wherein said resilient material is located between said first plate and said second plate;

wherein said first plate comprises a first top face and a first bottom face;

wherein said second plate comprises a second top face and a second bottom face;

wherein each of the at least three springs comprises a first end and a second end;

wherein each first end is connected to said first bottom face and each second end is connected to said second top face;

wherein the clip is coupled to the first top face; and wherein the button is coupled to the second bottom face.

2. The shock absorbing junction of claim 1, wherein said first plate comprises a first resilient material receiver surface; and wherein said second plate comprises a second resilient material receiver surface.

3. The shock absorbing junction of claim 1, wherein said resilient material is mechanically coupled to said first plate and said second plate.

4. The shock absorbing junction of claim 1, wherein said resilient material is chemically coupled to said first plate and said second plate.

5. The shock absorbing junction of claim 1; wherein said resilient material comprises a three axes impact absorption configuration between said first plate and said second plate.

6. The shock absorbing junction of claim 1, wherein the clip is coupled to the first top face with a bolt.

7. The shock absorbing junction of claim 1, wherein the button is coupled to second bottom face with a bolt.

8. A facemask system for absorbing impact between a face and the impact object comprising:

a helmet for covering a user's head;

a facemask;

a shock absorbent junction, wherein said shock absorbent junction comprises a first plate, a second plate and a resilient material located between said first plate and said second plate;

wherein said shock absorbent junction is located between said helmet and said facemask;

wherein said first plate comprises a first top face and a first bottom face, wherein said first top face comprises a first attaching mechanism;

wherein said second plate comprises a second top face and a second bottom face, wherein said second bottom face comprises a second attaching mechanism;

wherein the resilient material comprises at least three springs having a triangular configuration;

wherein each of the at least three springs comprises a first end and a second end;

wherein each first end is connected to said first bottom face and each second end is connected to said second top face;

wherein said first attaching mechanism comprises a clip having an opening for receiving a portion of the facemask;

wherein said first attaching mechanism mechanically couples the facemask to the first plate via the clip;

wherein said second attaching mechanism comprises a button shaped to mate with a slot in the helmet; and wherein said second attaching mechanism mechanically couples the helmet to the second plate via the button.

9. The facemask system for absorbing impact between a face and the impact object of claim 8, wherein said first plate comprises a first resilient material receiver surface; and wherein said second plate comprises a second resilient material receiver surface.

10. The facemask system for absorbing impact between a face and the impact object of claim 8, wherein said resilient material is mechanically coupled to said first plate and said second plate.

11. The facemask system for absorbing impact between a face and the impact object of claim 8, wherein said resilient material is chemically coupled to said first plate and said second plate.

12. The facemask system for absorbing impact between a face and the impact object of claim 8, wherein said resilient material comprises a three axes impact absorption configuration between said first plate and said second plate.

13. The facemask system for absorbing impact between a face and the impact object of claim 8, wherein the clip is coupled to the first top face with a bolt.

14. The facemask system for absorbing impact between a face and the impact object of claim 8, wherein the button is coupled to the second bottom face with a bolt.

* * * * *